United States Patent [19]

O'Dell

[11] Patent Number: 4,754,637

[45] Date of Patent: Jul. 5, 1988

[54] ELECTROMAGNETIC DENT REMOVING TOOL

[76] Inventor: Danny W. O'Dell, 1264 Sibley Blvd., Front, Calumet City, Ill. 60409

[21] Appl. No.: 38,622

[22] Filed: Apr. 14, 1987

[51] Int. Cl.[4] ..... B21D 1/12
[52] U.S. Cl. ..... 72/430; 72/705
[58] Field of Search ..... 72/56, 430, 705, 707

[56] References Cited

U.S. PATENT DOCUMENTS

| | | | |
|---|---|---|---|
| 2,054,248 | 9/1936 | Eronen | 72/705 |
| 3,695,089 | 10/1972 | Seekins | 72/430 |
| 4,252,008 | 2/1981 | Dibbens | 72/430 |

*Primary Examiner*—Lowell A. Larson

*Attorney, Agent, or Firm*—Willian Brinks Olds Hofer Gilson & Lione Ltd.

[57] ABSTRACT

A tool and method for removing dents from automobile bodies or the like. An outer tool unit comprising an electromagnet having an inner face which engages the outer surface of a body panel on at least one side of the dent. The outer tool unit is rigidly mounted from an external frame or its inner face must span the dent. The electromagnet is actuated at low amperage and then an inner tool unit positioned inside the body panel against the dent's inner surface. The inner tool unit may be simply a ferrous alloy material or it may be an electromagnet itself. The electromagnet is then actuated at a higher amperage, i.e., full operating power. In either event, the inner tool unit is rocked or "ironed" on the dent's inner surface and cooperates with the outer unit to progressively and uniformly remove the dent.

15 Claims, 3 Drawing Sheets

FIG 10
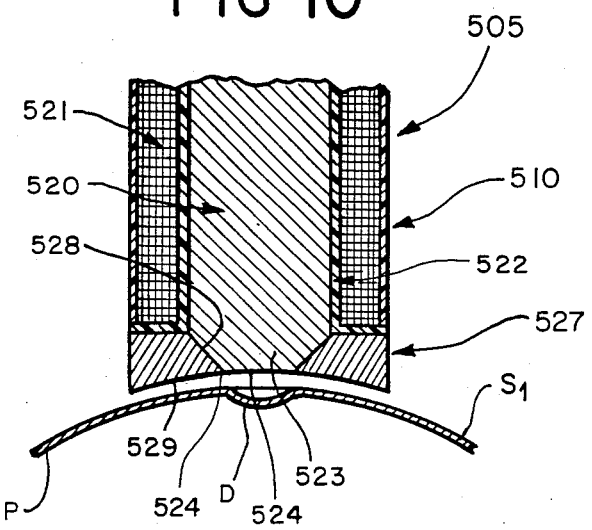
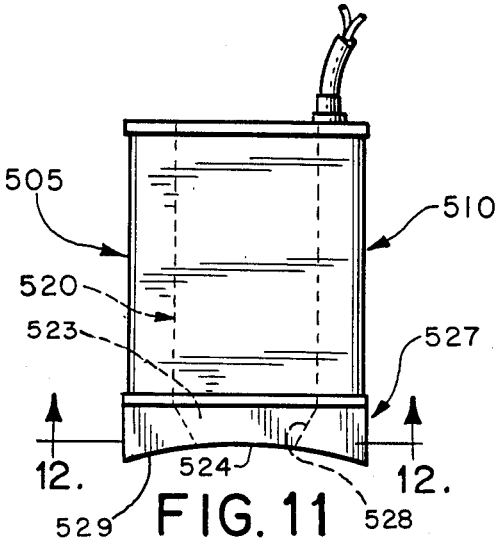
FIG. 11
FIG.12
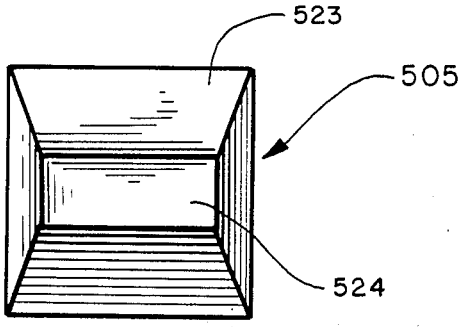
FIG.13
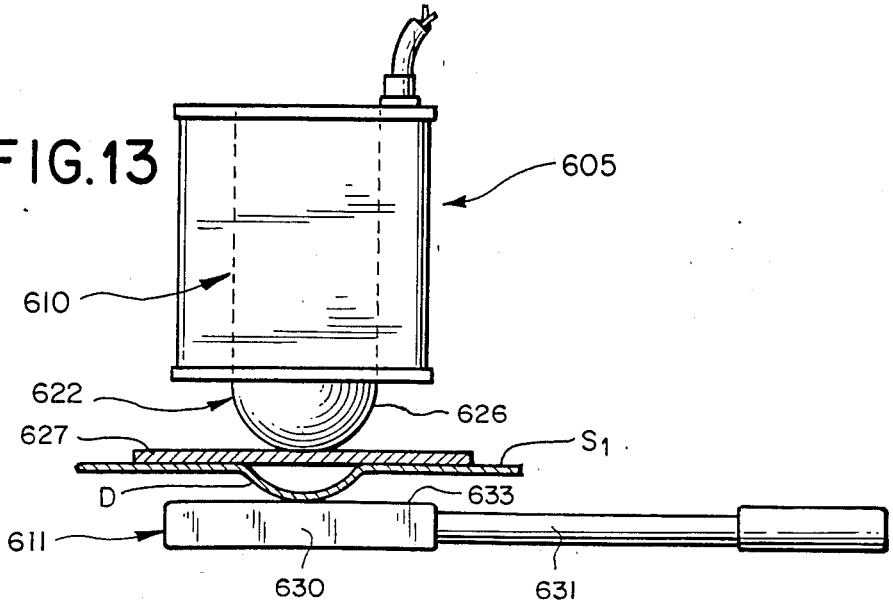

ELECTROMAGNETIC DENT REMOVING TOOL

FIELD OF THE INVENTION

This invention is in the field of sheet metalworking. It relates particularly to the removal of dents from the sheet metal skins of automobiles, airplanes and boats and the like.

BACKGROUND OF THE INVENTION

It has long been the dream of automobile body shop operators to have a dent removal tool which is inexpensive, easy to operate, and capable of removing dents with minimal damage to the finished, external surfaces of the body. Optimally, the tool would permit dent removal without the necessity for subsequent sanding, grinding, or refinishing operations.

The commercial aircraft industry has had the same interests. The skin of airplanes frequently becomes dented and requires repair, much like that of an automobile body. Unlike most automobiles, however, the skin of airplanes is conventionally made of aluminum. Automobiles, of course, normally have sheet steel bodies.

There have been numerous tools developed for dent removal from both automobile and airplane bodies. These include electromagnetic tools and pure mechanical tools. A brief discussion of a number of U.S. patents disclosing such tools is in order to more completely understand the prior art background against which the present invention was made.

The Reed U.S. Pat. No. 2,510,253 shows a mechanism for removing dents from automobile bodies or other articles constructed of magnetic sheet material. An electromagnetic apparatus, properly positioned, removes a dent from a sheet metal object upon energization of the electromagnetic means. A high degree of magnetization is effected to draw a workpiece flat against the face of a matrix formed in the shape of the desired surface.

The Sanchez U.S. Pat. No. 2,605,658 employs a sliding hammer which is adapted to produce a sharp shock or hammer blow to straighten a dent. An electromagnet secures the head of the tool to the base of a dent in an automobile door panel, for example. Actuation of a hammer device on the tool moving outwardly of the tool, is effective to pull the dent out of the panel, assisted by the electromagnetic force attraction of the head to the door panel.

The Crowder U.S. Pat. No. 2,696,240 uses magnetic metal elements which are placed on opposite sides of a dented metal skin in an aircraft or boat, for example. At least the outer member is an electromagnet, which is mounted on a tripod through screw adjustment means. After the magnet current is turned on, the screw is revolved and the member opposite the panel, which acts as an armature, slowly pushes out the dent as it follows the electromagnet on the screw.

The Furth U.S. Pat. No. 3,196,649 makes use of what it calls a "magnetic tension technique" of metal forming. In the first step, a magnetic field is generated in a primary coil that is held near the surface of the work. The device magnetically forms the metal workpiece by exerting magnetic pressure which pulls the workpiece toward the electrical conductor generating the magnetic field.

The Hanson et al. U.S. Pat. No. 3,998,081, the Hanson et al. U.S. Pat. No. 4,116,031, and the Hanson et al. U.S. Pat. No. 4,135,379, all show electromagnetic dent pullers developed primarily for the aircraft industry. These patents are all assigned to the Boeing Company, Seattle, Wash. Each uses powerful electromagnets using pulse field technology to remove dents.

These tools have had, for one reason or another, limited commercial success. This is particularly true in the automobile repair business, where no practical dent pulling tool which is effective but not prohibitively expensive has emerged.

SUMMARY OF THE INVENTION

It is an object of the present invention to provide an improved electromagnetic tool for effecting dent removal from magnetic and non-magnetic sheet metal surfaces.

Another object is to provide an improved electromagnetic tool which enables the body shop operator to quickly straighten dents in door panels, quarter panels, fenders, and the like, where the inside surface of the panel is virtually inaccessible to conventional mechanical impact devices.

It is still another object to provide an electromagnetic dent removal tool which is simple and easy to use.

It is a further object to provide an improved electromagnetic dent removing tool which is highly versatile.

It is still a further object to provide a new and improved method of removing dents from automobile bodies and the like.

The foregoing and other objects are realized in accord with the present invention by providing an outer electromagnet unit comprising an outer coil and an inner core. The core is fabricated of a high permeability iron alloy. It has a face on its inner end surface or, in the alternative, a face in a mold form of magnetic material which seats on the inner end of the core. The face engages the automobile's sheet metal skin over the dent.

According to one embodiment of the present invention, the face engages the surface of the sheet metal skin on opposite sides of the dent depression. In this context, the face may be curved, or it may be flat, i.e., to conform to the skin shape.

In the alternative, the outer unit may include an external support frame. In such case, the core face may engage the sheet metal skin surface on only one side of the dent depression. This approach is employed where a dent is too wide to be spanned by the face itself.

According to another embodiment of the invention, an inner electromagnetic unit is also provided. Preferably, the inner unit is also an electromagnet comprising a coil and an iron alloy core. However, the inner unit need not be an electromagnetic device, as long as it includes a ferrous metal element. The inner element may also have a milled head, which is slightly more arcuate than the original, or desired, shape of the sheet metal skin.

In operation, the outer unit is connected to a standard 110 VAC outlet through a rectifier to provide DC current to the unit at two different levels, either a low amperage of 1–5 amps or a high amperage of 10 amps or more. It is placed with its contact face flush against the automobile door panel, for example, over a dent in the panel. The electromagnet is energized at the low amperage level and fastens itself to the outer surface of the door panel.

At this point, the inner unit is positioned with its contact face against the inside surface of the dent. With door panels, this might involve placing the ferrous metal member in position with an elongated positioning handle, for example. The outer unit current input is then increased to the high amperage level. The curved surface of the face on the inner unit is rocked manually over the inner end of the dent while the magnetic field created by the outer unit draws the inner unit toward the core of the electromagnet in the outer unit. The rocking motion against the inner surface slowly forces the dent out to conform to the shape of the face on the outer core.

BRIEF DESCRIPTION OF THE DRAWINGS

The invention, including its construction and method of operation, is illustrated more or less diagrammatically in the drawings, in which:

FIG. 10 is a view similar to FIG. 1, albeit in section, of a fifth form of tool embodying features of the present invention;

FIG. 11 is a front elevational view of the outer tool unit in the tool of FIG. 10;

FIG. 12 is a view taken along line 12—12 of FIG. 11; and

FIG. 13 is a view similar to FIG. 1 of a sixth form of tool embodying features of the present invention.

DESCRIPTION OF THE PREFERRED EMBODIMENTS

Figure 1:
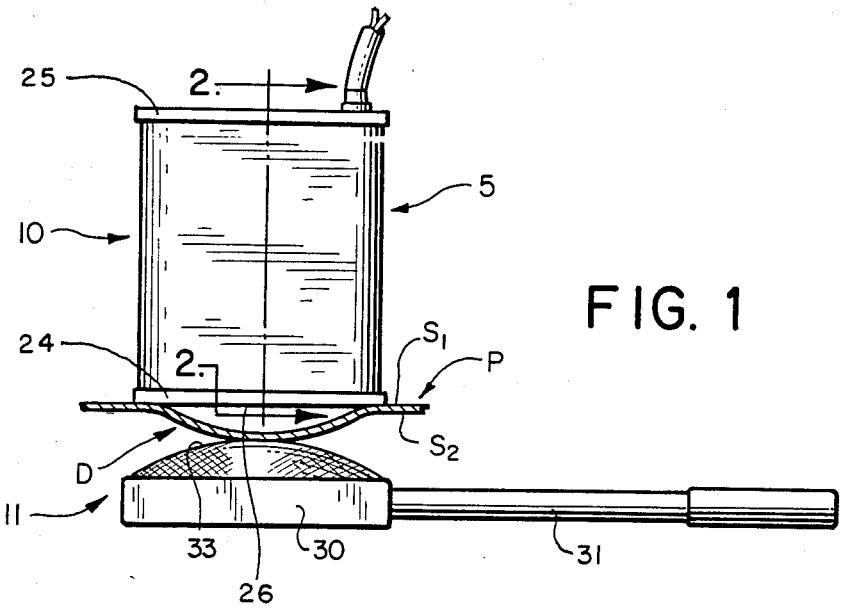
FIG. 1 is a front elevational view of an electromagnetic dent removing tool embodying a first form of the present invention, positioned for operation to remove a dent from an automobile door panel.
Figure 2:
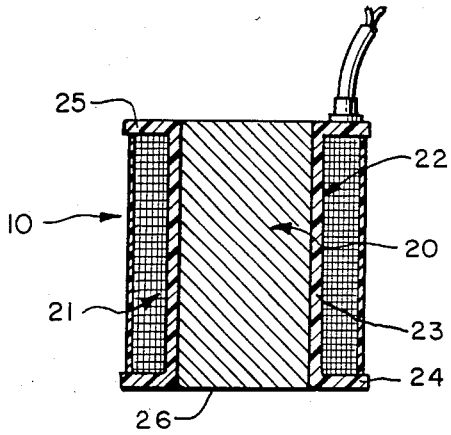
FIG. 2 is a sectional view taken along line 2—2 in the outer tool unit of the tool illustrated in FIG. 1.

Referring now to the drawings, and particularly to FIGS. 1 and 2, a tool embodying a first form of the present invention is seen generally at 5. The tool 5 comprises an outer tool unit 10 and an inner tool unit 11 which are positioned facing each other on opposite sides of the outer sheet metal panel P in an automobile door, for example.

As will be recognized, the panel P is illustrated with a somewhat spherical dent D formed inwardly into it. In this illustration the dent D is approximately one inch across and one-eighth to one-quarter inch deep, depressed from the outer surface $S_1$ of the panel P and extending inwardly of the inner surface $S_2$.

The tool unit 10 of the tool 5 is an electromagnet comprising a ferrous alloy core 20 and a surrounding coil 21. The core 20 is preferably square in cross section, about three inches on a side. The coil 21 is wrapped on a bobbin 22 fabricated of nonferrous material, such as plastic, which includes a sleeve 23 surrounding the core 20, an inner flange 24 and an outer flange 25. In the embodiment illustrated, the inner end of the core has a flat panel P engagement face 26 formed on it.

The inner tool unit 11 of the tool 5 comprises a square disk 30, also fabricated of a ferrous alloy, and an operating handle 31. The disk 30 has a partially spherical contact face 33. The radius of the arc of the face 33 is preferably relatively large; on the order of six inches, for example. The square face 33 has side lengths of at least one and one-half inches. The face 33 is milled to provide a roughened surface.

The handle 31 is affixed to one side of the disk 30, extending generally parallel to the face 33, away from the disk 30. The handle 31 is fabricated from any lightweight material and is about twelve inches long.

In operation of the tool 5, the tool unit 10 is positioned on the outer surface $S_1$ of a door panel, for example, over the dent D, with the core face 26 flat against the panel surface $S_1$. The face 26 is wide enough so that it completely spans the dent D, whereby it seats against the surface $S_1$ on opposite sides of the dent.

With the tool unit 10 positioned in this manner, the coil 21 is energized at the low amperage level. The core 20 fastens itself to the panel P, on its outer surface $S_1$, with the core face 26 spanning the dent D.

The operator then inserts the tool unit 11 through an edge access port (not shown) in a door, for example. He is able to manipulate the disk 30 using the handle 31 until the disk 30 is positioned directly opposite the tool unit 10. This is achieved through a combination of visual sighting, feeling the dent D, and the attraction of the magnetic field generated by the coil 21.

With the tool units 10 and 11 positioned in this manner the coil 21 is energized to the high amperage level and the handle 31 is manipulated to rock the disk 30. The milled face 33 of the disk 30 rocks back and forth across the dent D. This is accomplished while a strong magnetic field is maintained in the coil 21 of the tool unit 10.

The magnetic force of the tool unit 10, coupled with the rocking of the disk 30 of the tool unit 11, works the metal in the dent D. As the metal is worked, the dent D slowly collapses. When its outer surface $S_1$ reaches the core face 26 on the tool unit 10, the working process is complete.

In a modification of the first form of the invention, the tool is identical to that illustrated and described in FIGS. 1 and 2 except that pulsating current is used. This may be achieved by using periodically interrupted DC current under the control of a suitable control and timing means. The effect is to cause the inner tool unit 11 to impact against the dent D as it is repeatedly drawn against the dent and then released.

Figure 4:
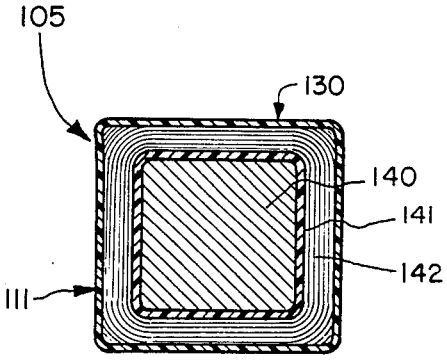
FIG. 4 is a sectional view through the inside tool unit of FIG. 3.
Figure 3:
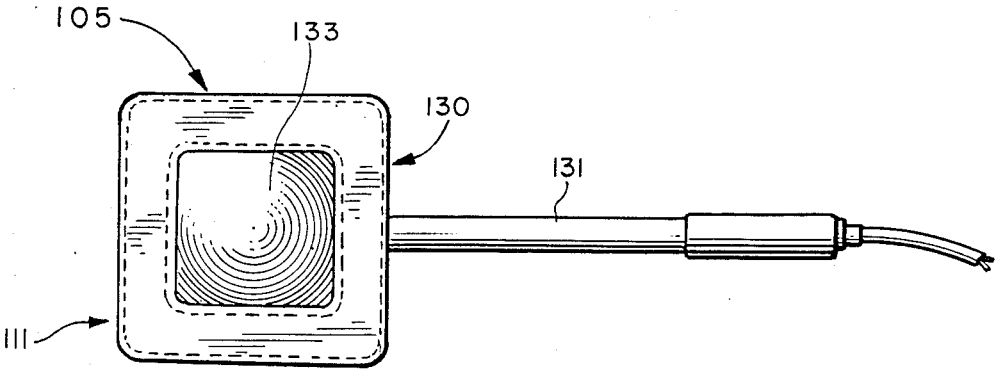
FIG. 3 is a top plan view of a modified form of the inside tool unit for the tool illustrated in FIG. 1.

Referring now to FIGS. 3 and 4, another modification of the tool embodying features of the first form of the invention is illustrated generally at 105. This tool 105 is exemplified by a modified inner tool unit, seen at 111.

Like the tool unit 11 hereinbefore discussed, the tool unit 111 also comprises a square body 130 and an operating handle 131. In the tool unit 111, however, the body 130 contains an electromagnet. It includes a core 140 inside a bobbin 141 on which a coil 142 is wound. Like the coil 21, the coil 142 is energized using standard current (AC) at 110 volts rectified to DC. The face 133 of the core is smooth, i.e., not milled.

When an outer tool unit 10 is employed with an inner tool unit 111 in the manner hereinbefore discussed, a higher magnitude of dent D removing force is achieved.

Although tool cost is also increased with this configuration, it is sometimes easier to remove dents, depending upon their configuration, size, and position in a panel. The use of a smooth face 133 is sometimes preferred with more fragile sheet metal and to forestall any damage to a thin undercoating material.

Figure 5:
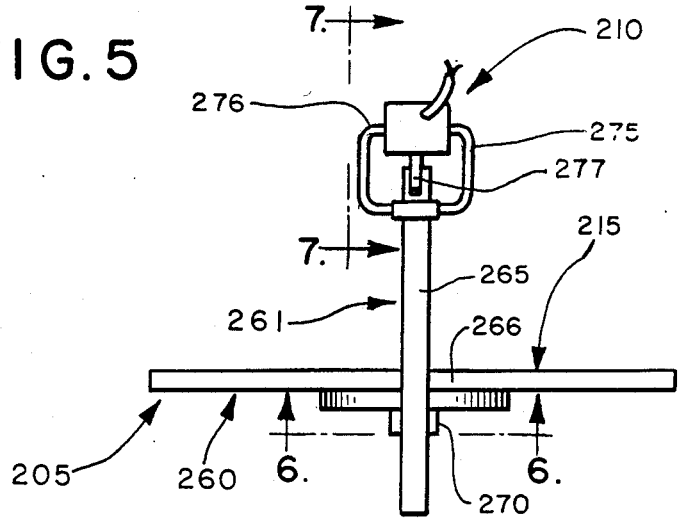
FIG. 5 is a top plan view of a tool embodying a second form of the present invention.
Figure 6:
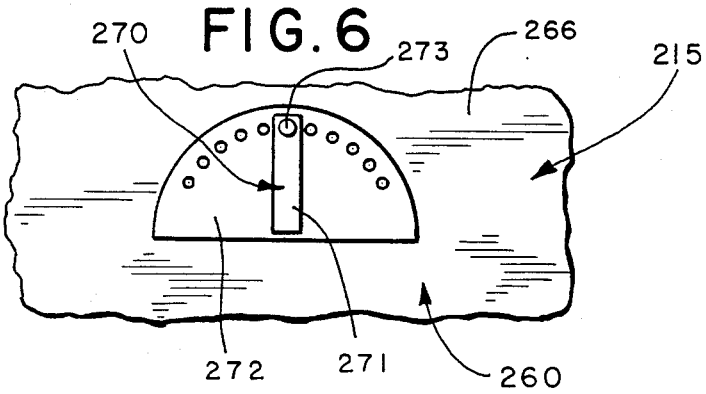
FIG. 6 is a view taken along line 6—6 of FIG. 5.
Figure 7:
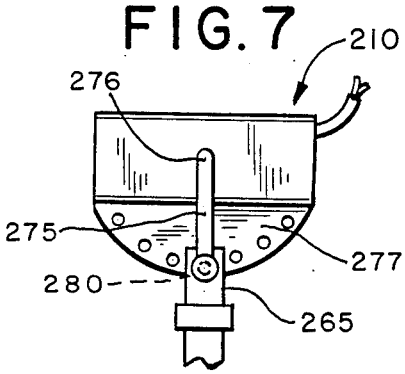
FIG. 7 is a front elevational view of the outer tool unit in the tool of FIGS. 5 and 6.

Referring now to FIGS. 5–7, a second form of tool embodying features of the invention is illustrated generally at 205. The tool 205 comprises an outer tool unit 210 and an inner tool unit (not shown) which are also positioned facing each other on opposite sides of the outer sheet metal panel in an automobile door, for example.

The tool 205 includes a frame 215 which supports the tool unit 210. The tool unit 210 is substantially identical to the tool unit 10 described in relation to the first form of the present invention.

The frame 215 includes an upright mounting panel 260 which is adapted to be supported from a garage floor, for example. The tool unit 210 is mounted on the panel 260 for universal adjustment relative to the panel on an arm mechanism 261.

The arm mechanism 261 includes a rigid arm 265 which is cantilevered from the panel 260. The arm 265 is connected to the panel 260 by any suitable structure, as for example at 270 in FIG. 6, which permits the arm to be rotated about its axis and fixed in any selected position. The arm 265 rotational position can be changed at will and fixed relative to the panel 260 by having its crank end 271 releasably secured to a locking segment 272 on the panel 260 with a removable pin 273, as seen in FIG. 6.

The arm mechanism 261 has a yoke 275 fixed to its inner end. The yoke 275 is pivotally connected to opposite sides of the tool unit 210 on journal pins 276. The tool unit 210 can be rotated relative to the yoke 275 on the pins 276 to permit angular adjustment of the tool unit relative to the panel P.

The angular position of the tool unit 210 is fixed relative to the arm 265 by a releasably locking segment 277 fastened to the unit to the end of the arm 265 with a removable pin 280. The tool unit 210 may be locked in any of a series of angularly displaced positions relative to the yoke 275, as seen in FIG. 7.

Angular adjustment of the tool unit 210 in the plane of the drawing about the pins 276 can be effected in this way. Angular adjustment of the tool unit in a plane perpendicular to the drawing can also be effected by rotating the arm 265 relative to its panel 260 in the manner hereinbefore discussed.

Two other adjustment modes are afforded. The arm 265 is constructed so it can telescope in a well-known manner. This permits movement of the tool unit 210 toward and away from the panel 260. Vertical movement of the panel 260, itself, on a suitable mounting structure, affords vertical tool unit 210 adjustment.

One purpose of this tool 205 construction is to permit work on dents which are wider than the face of the tool unit 210. The tool unit 210 can be precisely adjusted so that one side of the tool unit 210 face rests on a surface of the panel. This is necessary when a dent is wider than the width of the face, because the tool 205 would otherwise not be properly positioned relative to the panel to assure that the panel surface was returned to its original shape.

Once the tool unit 210 is properly positioned, an inner tool unit is operated in precisely the same manner as previously described. A dent is slowly worked out by manipulation of the inner tool unit.

Another purpose is to stabilize the outer tool unit 210. This is to assure that the unit 210 does not move during the operation. Movement could cause damage to the panel surface or the panel itself.

Figure 8:
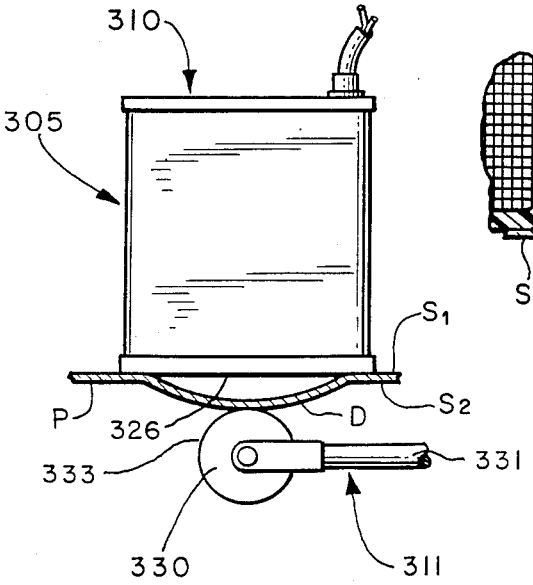
FIG. 8 is a view similar to FIG. 1 illustrating a third form of tool embodying features of the present invention.

Referring now to FIG. 8, a third form of tool embodying features of the present invention is shown generally at 305. The tool 305 includes an outer tool unit 310 which is identical in construction and operation to the tool unit 10 hereinbefore discussed. It is shown seated on the surface $S_1$ of an automobile panel P with its core face 326 spanning a dent D in the panel.

Opposite the panel P from the outer tool unit 310 is the inner tool unit 311 of the tool 5. The inner tool unit 311 comprises a cylindrical roller 330 fabricated of a ferrous alloy. The roller 330 is journaled for free rotation on one end of a handle 331. The contact face 333 of the roller 330 is shown as smooth, but could also be milled.

The tool 305 is operated in a manner similar to the tool 5 except that the inner tool unit 311 is rolled, rather than rocked, over the inner surface $S_2$ of the dent D. The effect is to slowly work the dent D out of the panel P with the roller 330 while it is under the influence of the strong magnetic field created by the tool unit 310.

Figure 9:
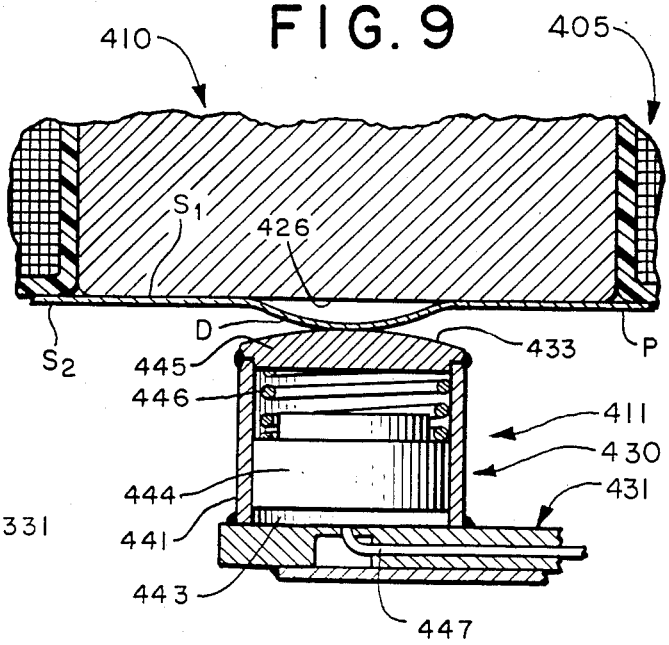
FIG. 9 is an enlarged view similar to FIG. 1 of a fourth form of tool embodying features of the present invention.

Turning now to FIG. 9, a fourth form of dent removal tool embodying features of the present invention is illustrated generally at 405. Like the tool 305, the tool 405 includes an outer tool unit 410 which is identical in construction and operation to the tool unit 10 discussed in relation to the first form of the present invention. The core face 426 seats on the surface $S_1$ of the panel P, spanning a dent D in the panel. Opposite the panel P from the tool unit 410, adapted to operate on the surface $S_2$ of the panel over the dent D, is the inner tool unit 411.

The inner tool unit 411 includes a head 430 and a handle 431. The head 430 has a segmentally spherical contact face 433 on it.

The head 430 comprises a cylinder 441 in which a hammer element 444 of non-ferrous material is slidably mounted. A coil spring 446 normally biases the hammer element 444 away from the end plate 445 of the cylinder 441, on the opposite side of which the contact face 433 is formed. Air under pressure may be directed to the bore 443 in the cylinder 441 through a pressurization conduit 447.

In operation of the tool 405, the outer tool unit 410 is utilized like the tool unit 10. The inner tool unit 411 is used quite differently. The hammer element 444 is repetitively moved away from the plate 445 by the bias of the spring 446 and then driven toward the face 433 by a charge of air under pressure. A series of hammer blows are delivered against the dent D. While this occurs, the operator "irons" the tool unit 411 slowly over the dent D so the force of the impacts is distributed. Removal of the dent D is accelerated.

Referring now to FIGS. 10–12, a fifth form of dent removal tool embodying features of the invention is illustrated generally at 505. The tool 505 is designed particularly for automobile panels P which have curved configurations.

As seen in FIG. 10, the tool 505 comprises an outer tool unit 510. An inner tool unit (not shown) is also employed, but it might take any of the various forms discussed, such as any of the tool units 11, 111, 311 or 411, for example.

The outer tool unit 510 is an electromagnet comprising a core 520 fabricated of a ferrous alloy and a surrounding coil 521 wrapped on a bobbin 522. In this sense it is similar to the tool unit 10. In the tool unit 510, however, a protruding tip 523 is provided.

The tip 522 is best seen in FIGS. 11 and 12. It is a wedge-shaped, separate member 523 fabricated of a ferrous alloy. The tip member 523 actually resembles a frustum of a pyramid, with a rectangular convex face 524 formed at its apex, spanning the dent D.

The tool unit 510 can be used with any of the aforedescribed tool units 11, 111, 311, or 411, in this configuration. The reduced area face 524 is effective to concentrate flux lines, permitting more localized and accurate work on small dents and creases, for example.

The tool unit 510 also has an accessory, however, in the form of a face plate 527 formed of non-ferrous material. The tip 522 seats in a correspondingly shaped opening 528 through the plate 527. The face plate 527 has an inner face 529 shaped like the convex face 524 on the tip 522. It seats on the surface $S_1$ of the panel P, spanning the dent D.

Referring now to FIG. 13, a sixth form of dent removal tool embodying features of the present invention is illustrated generally at 605. It comprises an outer tool unit 610 and an inner tool unit 611.

The outer tool unit 610 is similar in construction to the tool unit 10. In the tool unit 610, however, a tip 622 with a segmentally spherical contact face 626 is provided on the core of the unit 610.

The tip 622 is adapted to be rocked on an auxiliary plate 627 fabricated of thin, rigid, non-ferrous material. The plate 627, in turn, is shaped to seat flat against the surface $S_1$ of the panel P over a dent D.

The inner tool unit 611 is simply a disk 630 formed of ferrous material, and a handle 631. The disk 630 has a flat contact face 633 on it.

This tool 605 is used by rocking the unit 610 on the plate 627 while the dent D is "ironed" from below with the unit 611. The combination of shifting magnetic flux lines and the ironing effect is intended for dents D where the space behind them is limited, making it difficult or impossible to rock an inner tool.

While the process and product embodiments described herein are at present considered to be preferred, it is understood that various modifications and improvements may be made therein, and it is intended to cover in the appended claims all such modifications and improvements as fall within the true spirit and scope of the invention.

I claim:

1. A tool for removing a dent of predetermined width from sheet material, comprising:

(a) an outer tool unit being an electromagnet having a core surrounded by a coil, said outer tool unit including
  (i) an inner face having a configuration corresponding substantially to the configuration of the sheet material surrounding the dent;
  (ii) said inner face having a width greater than said predetermined width and adapted to be positioned against the outer surface of said sheet material spanning said dent; and (b) an inner tool unit being a metal element fabricated of magnetic material, said inner tool unit including
  (i) a contact face adapted to be positioned against the inner surface of said sheet material on said dent.

2. The tool of claim 1 further characterized in that:

(a) said coil is actuated with a pulsating current.

3. The tool of claim 1 further characterized in that:

(a) said contact face is generally segmentally spherical in configuration.

4. The tool of claim 3 further characterized in that:

(a) said contact face has a milled surface on it.

5. The tool of claim 1 further characterized in that:

(a) said inner tool unit includes an electromagnet.

6. The tool of claim 1 further characterized in that:

(a) said metal element of said inner tool being a roller rotatably mounted for rolling movement against said inner surface.

7. A tool for removing a dent of predetermined width from sheet material, comprising:

(a) an outer tool unit being an electromagnet having a core surrounded by a coil, said outer tool unit including
  (i) an inner face having a configuration corresponding substantially to the configuration of the sheet material surrounding the dent;
  (ii) said inner face adapted to be positioned against the outer surface of said sheet material on at least one side of said dent; and (b) an inner tool unit being a metal element fabricated of magnetic material, said inner tool unit including
  (i) a contact face adapted to be positioned against the inner surface of said sheet material on said dent.

8. The tool of claim 7 further characterized by and including:

(a) support means rigidly supporting said outer tool unit for angular adjustment relative to said sheet material.

9. The tool of claim 8 further characterized in that:

(a) said contact face is generally segmentally spherical in configuration.

10. The tool of claim 9 further characterized in that:

(a) said coil is actuated with a pulsating current.

11. The tool of claim 8 further characterized in that:

(a) said contact face has a milled surface on it.

12. The tool of claim 7 further characterized in that:

(a) said inner tool unit includes an electromagnet.

13. The tool of claim 1 or 3 further characterized in that:

(a) said inner tool includes a hammer member movable relative to said metal element; and (b) means for actuating said hammer member.

14. A method for removing a dent of predetermined width from sheet material, comprising the steps of:

(a) providing an outer tool unit in the form of an electromagnet having a core surrounded by a coil and an inner face having a configuration corresponding substantially to the configuration of the sheet material surrounding the dent;

(b) positioning said inner face against the outer surface of said sheet material so that it engages said outer surface on opposite sides of the (c) actuating said electromagnet of said outer tool unit at low amperage;

(d) positioning an inner tool unit fabricated of magnetic material so that its contact face is against the inner surface of said sheet material on said dent;

(e) actuating said electromagnet of said outer tool unit at a higher amperage; and (f) moving said inner tool unit so that said contact face moves on said inner surface.

15. The method of claim 14 further characterized in that:

(a) said inner tool unit is also provided with an electromagnet;

(b) actuating said inner tool electromagnet while it is being moved relative to said inner surface.

* * * * *